US008093792B2

(12) United States Patent
Knorr

(10) Patent No.: US 8,093,792 B2
(45) Date of Patent: Jan. 10, 2012

(54) HEADLIGHT LAMP

(75) Inventor: Klaus Knorr, Nennslingen (DE)

(73) Assignee: Osram AG, München (DE)

( * ) Notice: Subject to any disclaimer, the term of this patent is extended or adjusted under 35 U.S.C. 154(b) by 501 days.

(21) Appl. No.: 12/083,259

(22) PCT Filed: Oct. 5, 2006

(86) PCT No.: PCT/EP2006/067115

§ 371 (c)(1),
(2), (4) Date: Apr. 7, 2008

(87) PCT Pub. No.: WO2007/042464

PCT Pub. Date: Apr. 19, 2007

(65) Prior Publication Data

US 2009/0066213 A1 Mar. 12, 2009

(30) Foreign Application Priority Data

Oct. 7, 2005 (DE) ..... 10 2005 048 444

(51) Int. Cl.
*H01J 5/02* (2006.01)

(52) U.S. Cl. ..... 313/312; 313/315

(58) Field of Classification Search ..... 313/312, 313/315

See application file for complete search history.

(56) References Cited

U.S. PATENT DOCUMENTS

| | | | | |
|---|---|---|---|---|
| 5,578,893 | A | 11/1996 | Yamamoto | |
| 5,811,934 | A * | 9/1998 | Bunk et al. | 313/579 |
| 6,369,510 | B1 * | 4/2002 | Shaw et al. | 313/635 |
| 2001/0004319 | A1 | 6/2001 | Nakamura et al. | |
| 2002/0021065 | A1 * | 2/2002 | Gervelmeyer et al. | 313/112 |

FOREIGN PATENT DOCUMENTS

| | | | |
|---|---|---|---|
| DE | 403 99 48 | A1 | 6/1992 |
| DE | 100 40 887 | A1 | 8/2001 |
| EP | 0461508 | A2 | 6/1991 |
| EP | 1 134 780 | A2 | 9/2001 |
| WO | WO 9605610 | A1 | 2/1996 |

OTHER PUBLICATIONS

United Nations Economic Commission for Europe (UNECE), Regulation No. 37: "Uniform Provisions Concerning the Approval of Filament Lamps for use in Approved Lamp Units on Power-Driven Vehicles and of their Trailers", Revision 4, Oct. 26, 2005, XP002411792, Sheets H4/2, Sheets H7/1-H7/3, Abstract.

* cited by examiner

*Primary Examiner* — Toan Ton
*Assistant Examiner* — Andrew Coughlin
(74) *Attorney, Agent, or Firm* — Cozen O'Connor

(57) ABSTRACT

A headlight lamp with at least one incandescent filament, which is surrounded by a lamp vessel. The at least one incandescent filament is constructed in such a way that during lamp operation it generates a luminous flux, the value of which is greater than a predetermined permissible maximum value for the luminous flux of the lamp. The lamp vessel has a region of reduced transparency, with the aid of which the luminous flux emerging from the headlight lamp during lamp operation is reduced to a value of less than or equal to the predetermined permissible maximum value.

2 Claims, 8 Drawing Sheets

HEADLIGHT LAMP

RELATED APPLICATIONS

This is a U.S. national stage of application No. PCT/EP2006/067115, filed on 5 Oct. 2006.

This patent application claims the priority of German patent application no. 10 2005 048 444.1 filed Oct. 7, 2005, the disclosure content of which is hereby incorporated by reference.

FIELD OF THE INVENTION

The invention relates to a headlight lamp, in particular a halogen incandescent lamp for a vehicle headlight, which is surrounded by a lamp vessel.

BACKGROUND OF THE INVENTION

Such a headlight lamp is disclosed, for example, in EP 0 461 508 A2. This specification describes a halogen incandescent lamp for a motor vehicle headlight, which has a vitreous lamp vessel with an incandescent filament arranged therein. The lamp vessel is fixed in a metal base, which has been equipped with the electrical terminals of the lamp. This headlight lamp is a so-called H1 lamp.

WO 96/05610 A1 describes a headlight lamp of the H4 lamp type with two incandescent filaments, which are surrounded by a vitreous lamp vessel, which is fixed in a metal base. The dome, which is remote from the metal base, of the lamp vessel has been provided with a black, opaque coating in order to avoid glare and spill light from the dome.

SUMMARY OF THE INVENTION

The object of the invention is to provide a headlight lamp which has a higher luminance in comparison with conventional headlight lamps and whose luminous flux does not exceed the permissible upper limit in accordance with ECE Regulation 37.

The headlight lamp according to an embodiment of the invention has at least one incandescent filament, which is surrounded by a lamp vessel and is constructed in such a way that during lamp operation it generates a luminous flux whose value is greater than a predetermined permissible maximum value for the luminous flux of the lamp. In addition, the lamp vessel has a region of reduced transparency, which, during lamp operation, reduces the luminous flux emerging from the headlight lamp to a value of less than or equal to the predetermined permissible maximum value for the luminous flux of the lamp. As a result, with the headlight lamps according to an embodiment of the invention the luminance is markedly increased in comparison with conventional headlight lamps.

FIGS. 1 and 2 illustrate corresponding comparison values using the example of headlight lamps of the H1 type for a conventional H1 lamp 1 and an H1 lamp 2 according to an embodiment of the invention for illustrative purposes. As shown in FIG. 1, the conventional H1 lamp 1 on a supply voltage of 13.2 V produces a luminous flux of 1475 lm, while the H1 lamp 2 according to an embodiment of the invention, given the same supply voltage, generates a luminous flux of 1715 lm. The standard mean value for the luminous flux for H1 lamps in accordance with the prior art is 1550 lm. In the case of the H1 headlight lamp according to an embodiment of the invention, the incandescent filament is constructed in such a way that it generates a luminous flux whose value is markedly greater than the permissible maximum value for the luminous flux of H1 lamps, as predetermined in accordance with the standard ECE Regulation 37, of 1782.5 lm. Preferably, in the case of the H1 lamp according to an embodiment of the invention, the incandescent filament is constructed in such a way that it generates a luminous flux of more than 2000 lm, which, by means of the abovementioned lamp vessel region with reduced transparency, is reduced to a value of less than or equal to the permissible maximum value for the luminous flux for H1 lamps of 1782.5 lm, in accordance with the example in FIG. 1 to a value of 1715 lm. This means that the H1 lamp 2 according to an embodiment of the invention produces a luminous flux which is increased in comparison with the conventional H1 lamp 1 by 16 percent.

FIG. 2 shows a comparison of the luminances for these headlight lamps. The conventional H1 lamp 1 has a luminance of $2.3 \cdot 10^7$ cd/m$^2$, and the H1 lamp 2 according to an embodiment of the invention has a luminance of $3.7 \cdot 10^7$ cd/m$^2$. Consequently, the luminance of the H1 lamp 2 according to the invention is 61 percent higher than that of the conventional H1 lamp 1. As a result of its higher luminance, the headlight lamp according to an embodiment of the invention is superior both when it is used in a lower beam headlight and in an upper beam headlight of a conventional headlight lamp since it ensures a higher illuminance at the important distances or in the case of the important range values in front of the headlight.

FIG. 3 shows, by way of example, a comparison of the illuminance at the important distances of a lower beam headlight for right-hand traffic in accordance with the specification ECE/324 Regulation No. 112 when using a conventional H1 lamp and an H1 lamp according to an embodiment of the invention as the light source in the lower beam headlight of a motor vehicle.

FIG. 4 shows the same comparison when using the same lamps as the light source in the lower beam headlight of another motor vehicle. It can be seen from the comparison values in FIGS. 3 and 4 that the headlight lamp 2 according to an embodiment of the invention in the lower beam headlights of both vehicle types ensures a considerable increase in the illuminance at the important distances 75R, 50R, 50V, 25L, 25R and zone IV in accordance with ECE/324 Regulation No. 112 in comparison with the conventional headlight lamp 1 on a screen at a distance of 25 m in front of the headlight.

FIG. 5 shows a comparison of the illuminance in the optical axis H/V and at the maximum of the illuminance when using a conventional H1 lamp 1 and an H1 lamp 2 according to an embodiment of the invention in an upper beam headlight of a motor vehicle.

FIG. 6 shows the same comparison for the same lamps in the upper beam headlight of another motor vehicle. It can be seen from the comparison values in FIGS. 5 and 6 that the H1 lamp 2 according to an embodiment of the invention makes possible a considerable increase in the illuminance both in the optical axis H/V and at the maximum of the illuminance in comparison with the conventional H1 lamp 1 in the upper beam headlight of both motor vehicles.

The invention can also be used for other headlight lamps, which generally do not have an opaque dome, such as on H2 and H3 lamps, for example. For H2 lamps, the permissible maximum value for the luminous flux in accordance with ECE Regulation 37 given a supply voltage of 13.2 volts is, for example, 2070 lm, while the permissible maximum value for the luminous flux of H3 lamps in accordance with ECE Regulation 37 given a supply voltage of 13.2 V is 1667.5 lm.

Preferably, the at least one incandescent filament of the headlight lamp according to an embodiment of the invention is constructed in such a way that during lamp operation it generates a luminous flux which is at least 10 percent above the permissible maximum value for the luminous flux of the lamp, but the region with reduced transparency of the lamp vessel means that the luminous flux emerging from the lamp according to the invention is reduced to a value of less than or equal to the previously mentioned permissible maximum value for the luminous flux of the lamp and therefore the specification in accordance with ECE Regulation 37 is adhered to.

In accordance with the preferred exemplary embodiment of the invention, the region of the lamp vessel with reduced transparency is arranged at that end of the lamp vessel which is remote from the lamp base and which is preferably in the form of a dome. Preferably, the region of the lamp vessel with reduced transparency extends not only over the dome of the lamp vessel but in addition also over part of an axially symmetrical section, which adjoins the dome, of the lamp vessel.

The region of the lamp vessel with reduced transparency is advantageously in the form of an opaque coating on the surface of this lamp vessel region since this coating can be produced using comparatively simple means. For example, carbonyl irons can be used for this coating, as is known from the dome coating in H4 and H7 lamps.

In accordance with the preferred exemplary embodiment of the invention, the distance between the region of the lamp vessel with reduced transparency and a reference plane of the lamp base, with respect to which the position of the at least one incandescent filament is adjusted, is 31.50 millimeters±0.30 millimeter.

BRIEF DESCRIPTION OF THE DRAWINGS

The invention will be explained in more detail below with reference to a preferred exemplary embodiment. In the drawing.

DETAILED DESCRIPTION OF THE DRAWINGS

Figure 1:
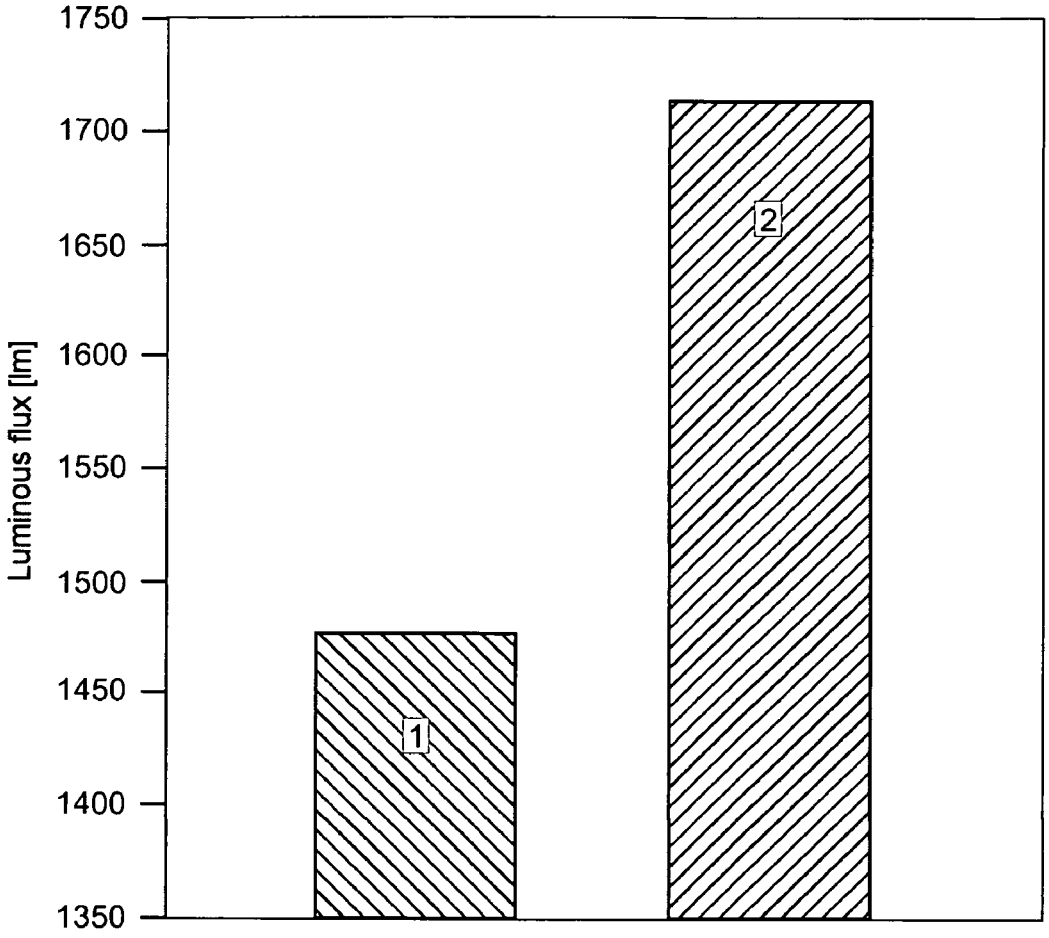
FIG. 1 shows a comparison of the luminous flux of an H1 lamp according to the invention with a conventional H1 lamp in accordance with the prior art.
Figure 2:
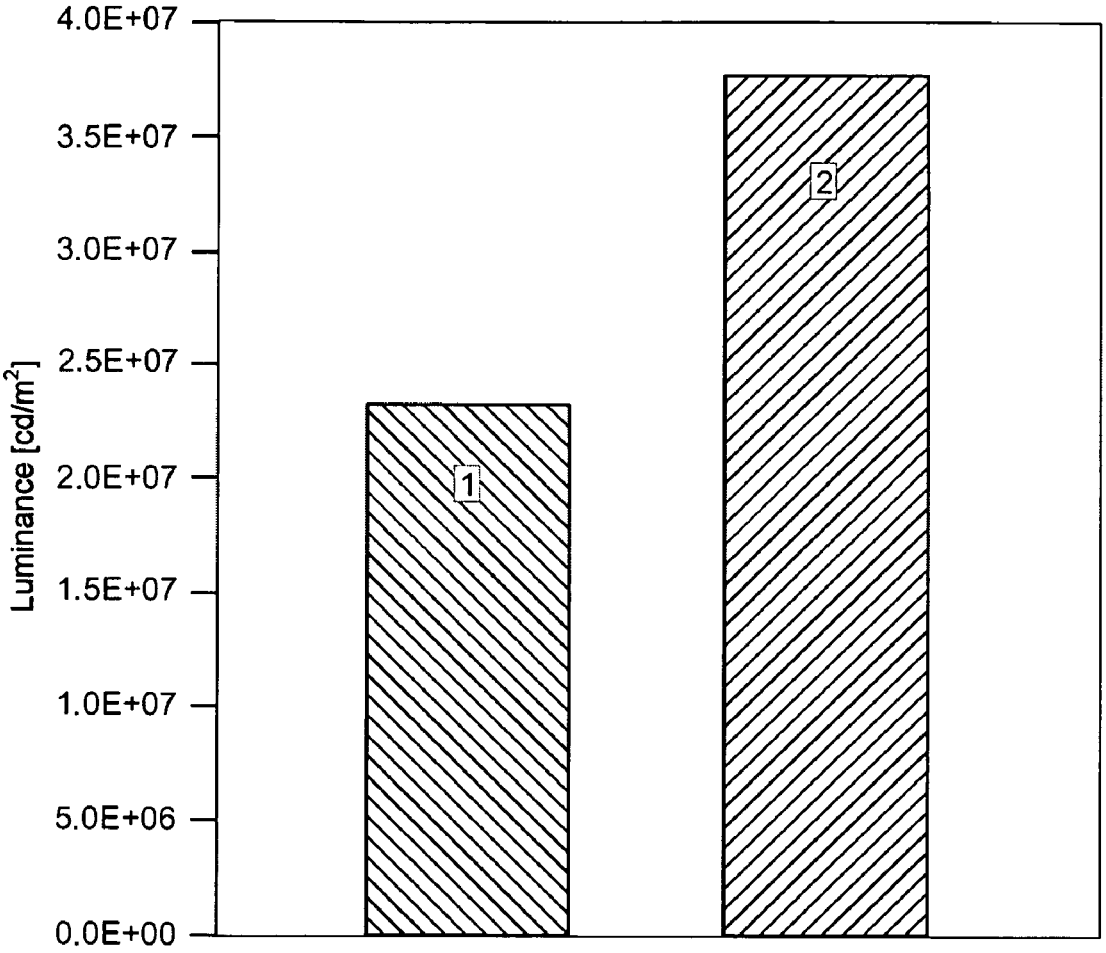
FIG. 2 shows a comparison of the luminance of an H1 lamp according to the invention with a conventional H1 lamp in accordance with the prior art.
Figure 3:
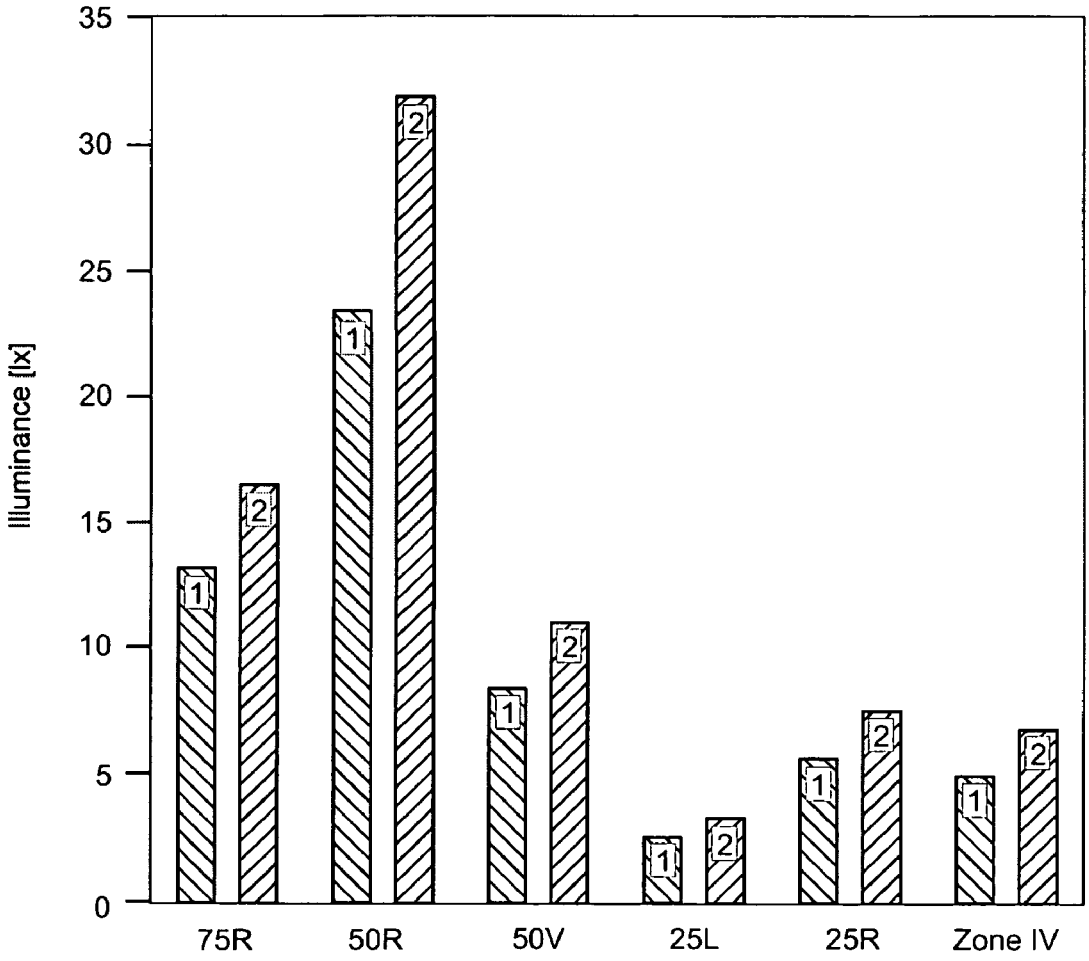
FIG. 3 shows a comparison of the illuminance when using an H1 lamp according to the invention and a conventional H1 lamp in accordance with the prior art as the light source in the lower beam headlight of a motor vehicle.
Figure 4:
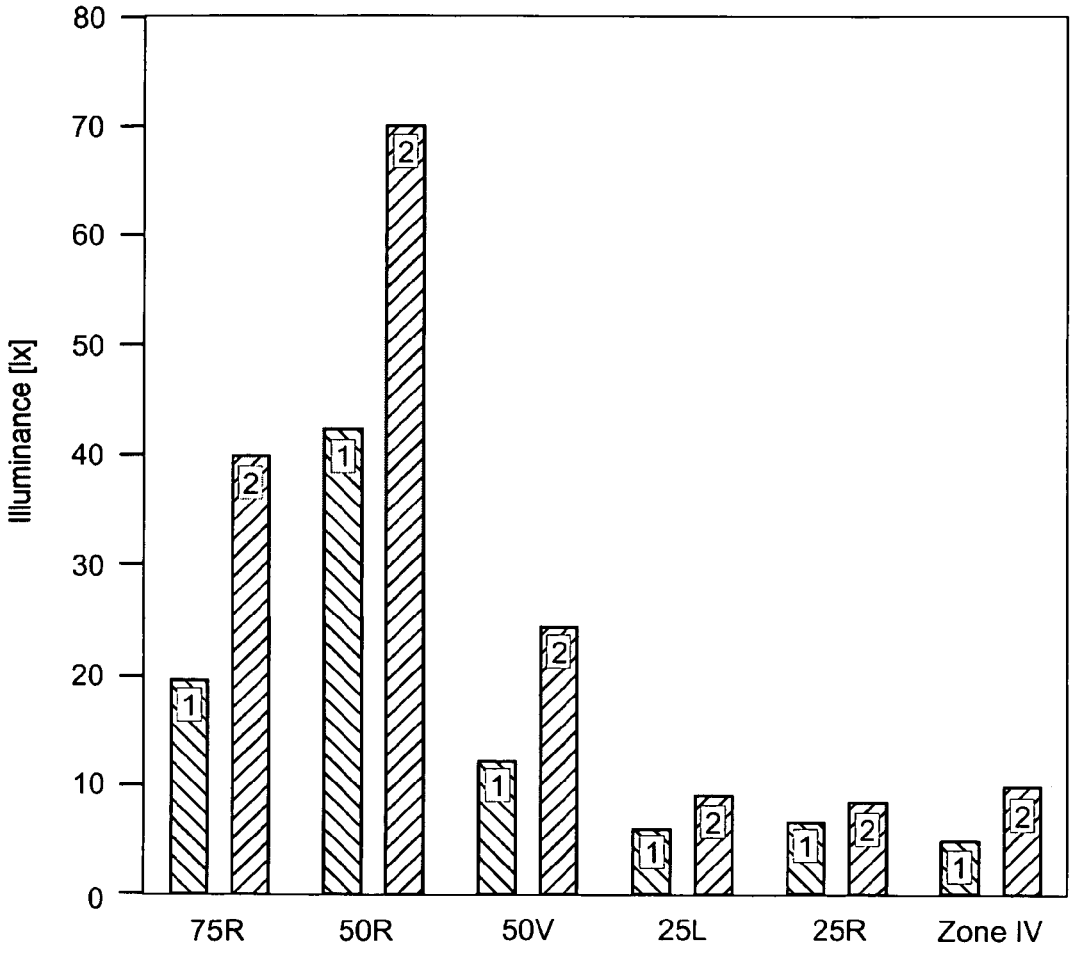
FIG. 4 shows a comparison of the illuminance when using an H1 lamp according to the invention and a conventional H1 lamp in accordance with the prior art as the light source in the lower beam headlight of another motor vehicle.
Figure 5:
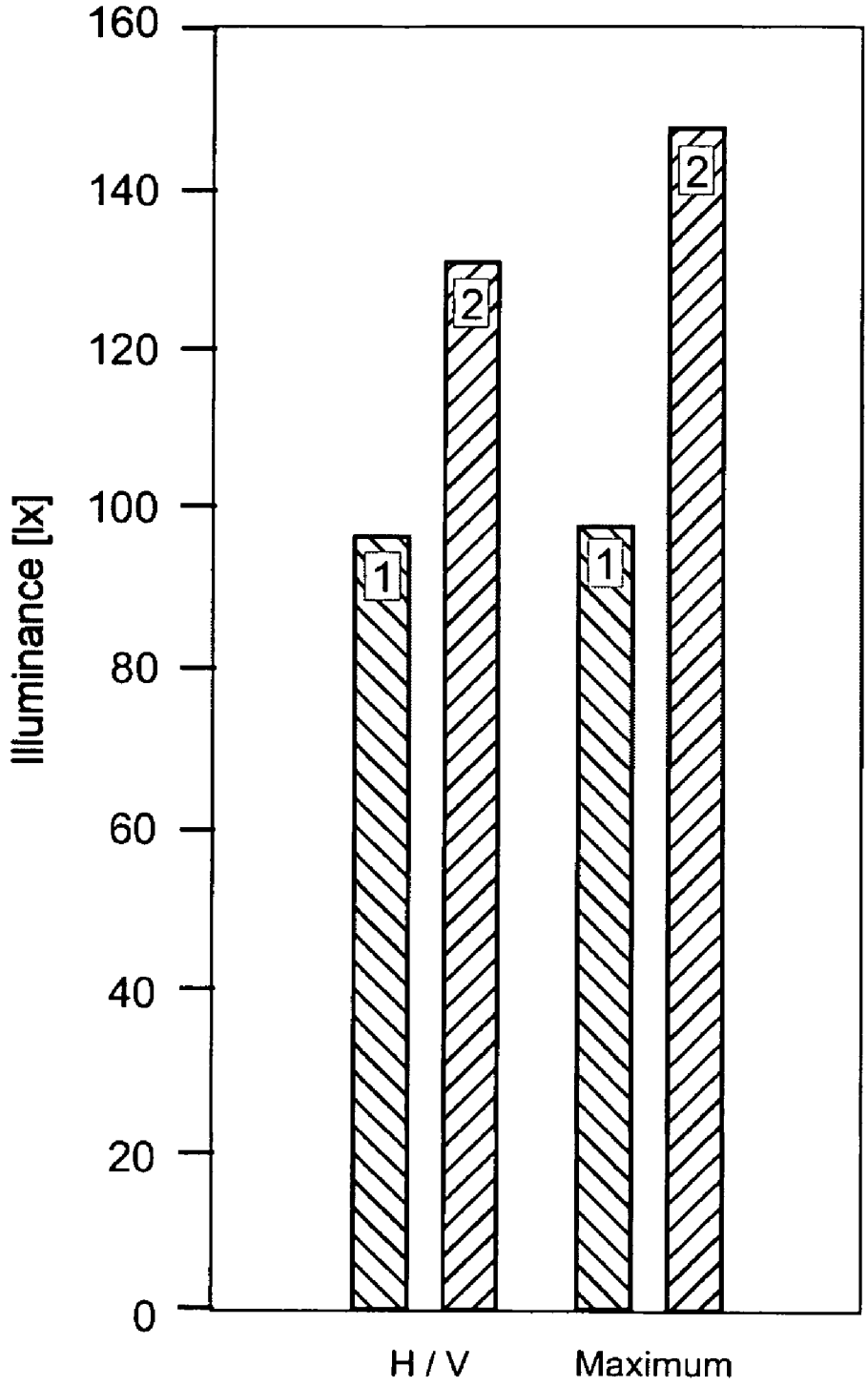
FIG. 5 shows a comparison of the illuminance when using an H1 lamp according to the invention and a conventional H1 lamp in accordance with the prior art as the light source in the upper beam headlight of a motor vehicle.
Figure 6:
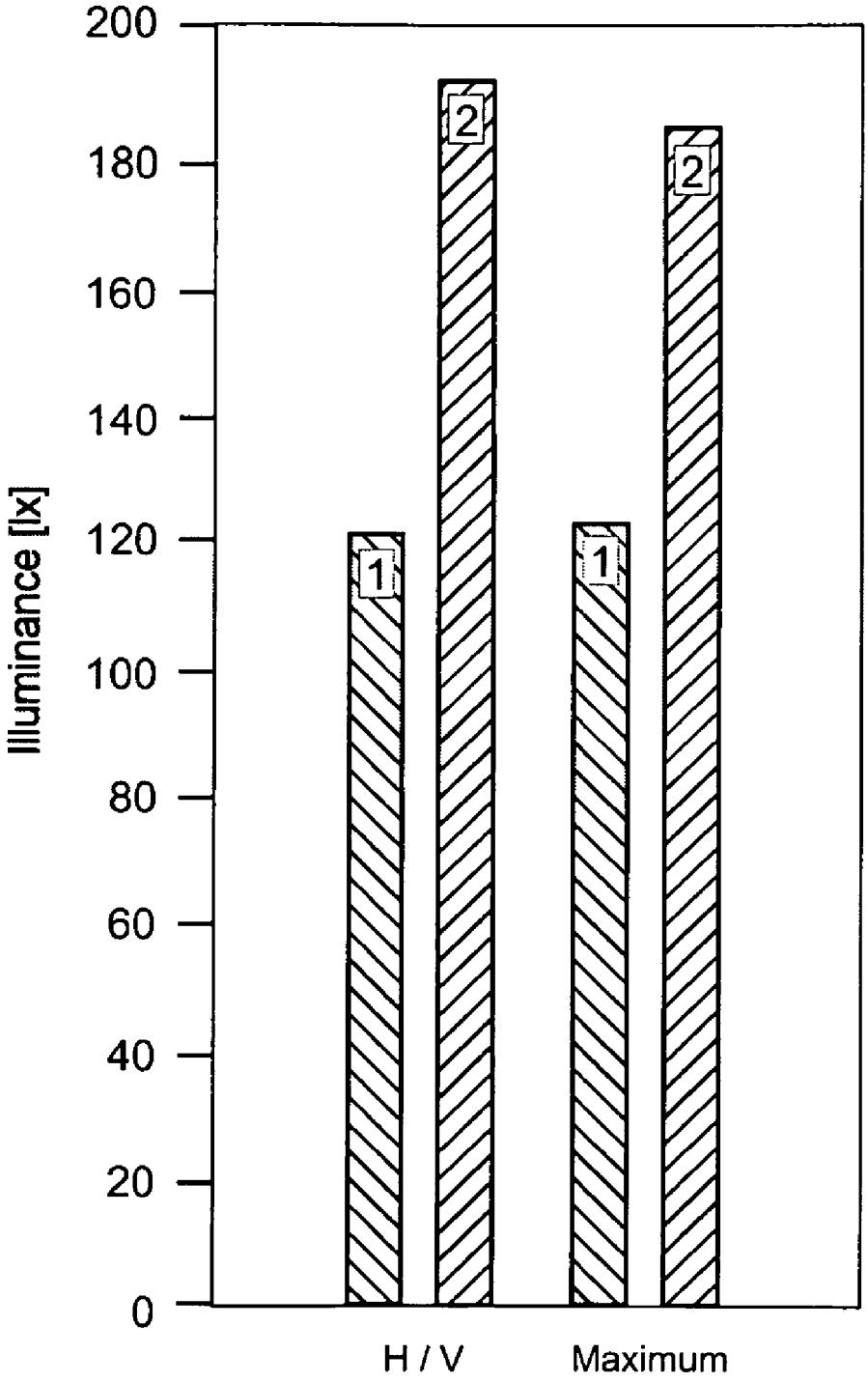
FIG. 6 shows a comparison of the illuminance when using an H1 lamp according to the invention and a conventional H1 lamp in accordance with the prior art as the light source in the upper beam headlight of another motor vehicle.
Figure 7:
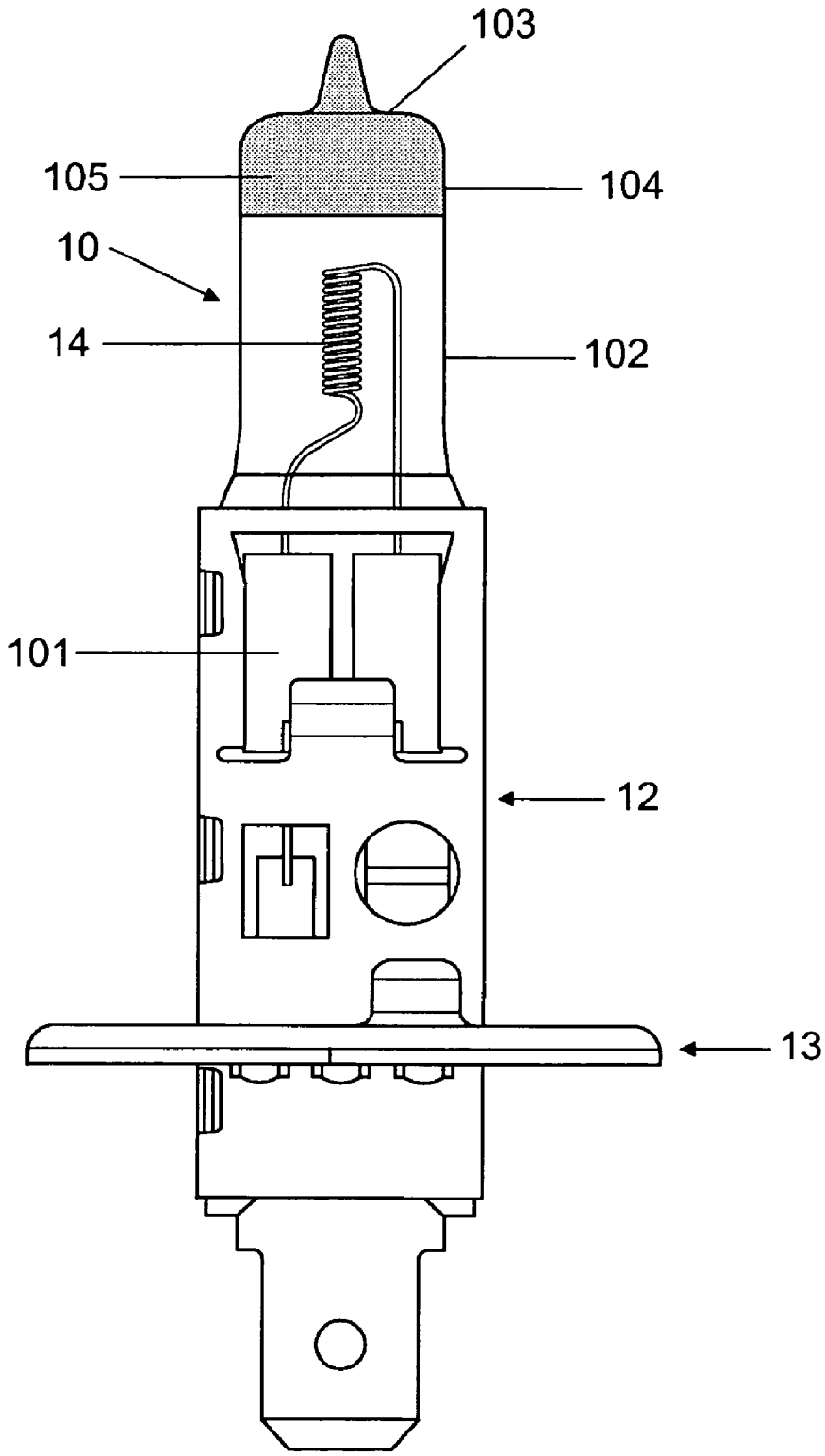
FIG. 7 shows a side view of a headlight lamp according to the invention in a schematic illustration.
Figure 8:
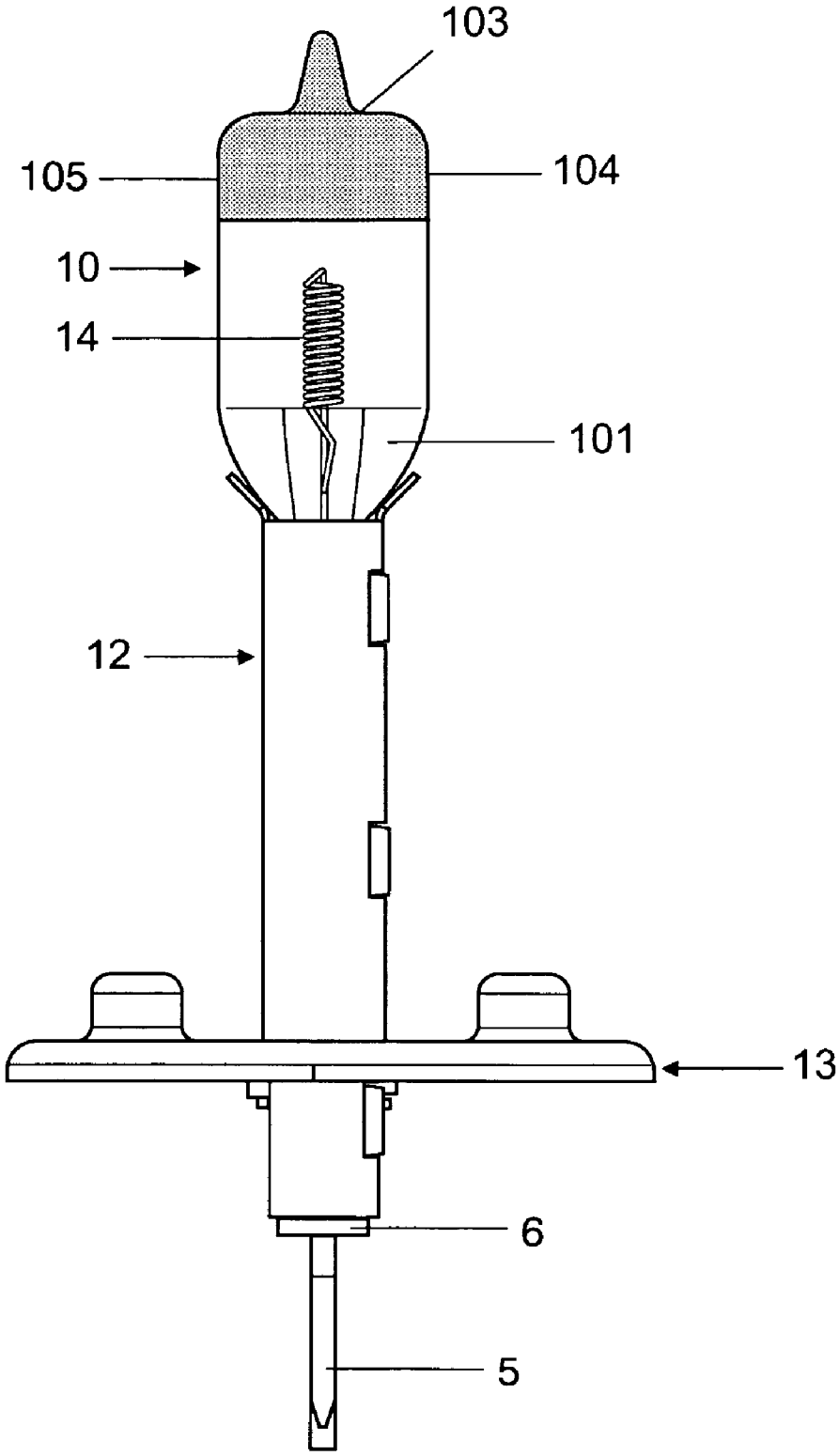
FIG. 8 shows a side view of the headlight lamp shown in FIG. 7 in a side view, which has been rotated through 90 degrees about its longitudinal axis, and in a schematic illustration.

FIGS. 7 and 8 show, schematically, two different side views of a headlight lamp according to the invention. This headlight lamp is a halogen incandescent lamp of the H1 type, which has a rated voltage of 12 volts and an electrical power consumption of 55 watts. This headlight lamp has a vitreous lamp vessel 10 with a sealed-off end 101, which is fixed in a metallic base sleeve of the lamp base 12. The lamp base 12 has been equipped with a base flange 13, with respect to which the physical position of the incandescent filament 14, which is surrounded by the lamp vessel 10, is adjusted. The base flange plane defines a reference plane for the adjustment of the incandescent filament 14. The lamp vessel 10 has a dome 103, which is positioned opposite its sealed-off end 101. That section 102 of the lamp vessel 10 between the sealed-off end 101 and the dome 103 which surrounds the incandescent filament 14 is axially symmetrical, in particular circular-cylindrical. The dome 103 and part 104 of the circular-cylindrical lamp vessel section 102, which adjoins said dome 103, are provided, on their outer surface, with an opaque coating 105 comprising carbonyl irons, for example. The distance between the coating 105 and the base flange 13 of the lamp base 12 is 31.50 mm±0.30 mm. The incandescent filament 14 has a single filament, has 15 turns, a core diameter of 652.3 micrometers, a core factor of 3.922, a pitch of 288.9 micrometers, a pitch factor of 1.737, a cold resistance of 102.29 milliohms and an effective wire length of 39.84 mm. The effective wire length denotes the length of the wire of the coiled part of the incandescent filament 14. In comparison with the conventional H1 lamp, with the H1 lamp in accordance with the preferred exemplary embodiment of the invention the incandescent filament 14 has a cold resistance which is reduced by approximately 17.4 percent. During operation of the lamp on a supply voltage of 13.2 V, the incandescent filament 14 generates a luminous flux of 2012 lm, which is reduced to a value of 1715 lm by means of the coating 105.

The invention is not restricted to the exemplary embodiment of the invention which is explained in more detail above, but can also be applied to other headlight lamps, for example H2 and H3 lamps. In addition, the invention can also be applied to two-filament lamps, for example to H15 lamps. H15 lamps have an incandescent filament for producing the daytime driving light and a further incandescent filament for producing the upper beam. In order to increase the luminance for the upper beam application, the upper beam filament can be constructed in a such a way that during operation it generates a luminous flux whose value is greater than a predetermined permissible maximum value for the luminous flux of the H15 lamp, and for example the dome of the lamp vessel has an opaque coating, with the aid of which the luminous flux emerging from upper beam incandescent filament is reduced to a value of less than or equal to the predetermined permissible maximum value.

In addition, the invention can also be applied to headlight lamps which are designed for a different on-board rated voltage than 12 V, for example for an on-board rated voltage of 24 V.

I claim:

1. An H1-type headlight lamp comprising an incandescent filament and a lamp vessel surrounding the incandescent filament, wherein the incandescent filament is constructed to generate a luminous flux, the value of which is greater than 2000 lm and greater than a predetermined permissible maximum value for the luminous flux of H1-type headlight lamps during lamp operation with a supply voltage of 13.2 volts, wherein the lamp vessel has a sealed-off end fixed in a lamp base, a dome positioned opposite from said sealed-off end, and an axially symmetrical lamp vessel section arranged between said sealed-off end and said dome, and wherein a surface of said dome and a part of said axially symmetrical lamp vessel section which adjoins said dome are covered by an opaque coating, said opaque coating providing a reduction of the luminous flux emerging from the headlight lamp during lamp operation to a value less than or equal to the predetermined permissible maximum value.

2. The headlight lamp as claimed in claim 1, wherein a distance between a region covered by said opaque coating and a reference plane of the lamp base, with respect to which a position of the at least one incandescent filament is adjusted, has a value in a region of 31.50 millimeters±0.30 millimeter.

* * * * *